US009127880B2

(12) United States Patent
Park et al.

(10) Patent No.: US 9,127,880 B2
(45) Date of Patent: Sep. 8, 2015

(54) REFRIGERATOR VEGETABLE ROOM WITH VARIABLE PRESSURE

(71) Applicant: LG ELECTRONICS INC., Seoul (KR)

(72) Inventors: Ahreum Park, Seoul (KR); Dullae Min, Seoul (KR); Moongyo Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/951,994

(22) Filed: Jul. 26, 2013

(65) Prior Publication Data

US 2014/0028166 A1 Jan. 30, 2014

(30) Foreign Application Priority Data

Jul. 26, 2012 (KR) ..... 10-2012-0081925

(51) Int. Cl.

| | |
|---|---|
| ***A47B 96/04*** | (2006.01) |
| ***A47B 95/00*** | (2006.01) |
| ***A47B 96/00*** | (2006.01) |
| ***A47B 77/08*** | (2006.01) |
| ***A47F 3/04*** | (2006.01) |
| ***F25D 17/04*** | (2006.01) |
| ***F25D 23/00*** | (2006.01) |
| ***F25D 23/04*** | (2006.01) |

(52) U.S. Cl.

CPC ..... *F25D 23/04* (2013.01); *F25D 17/042* (2013.01); *F25D 23/003* (2013.01); *F25D 2317/043* (2013.01)

(58) Field of Classification Search

CPC ..... F25D 17/042; F25D 2317/043; F25D 23/003; F25D 23/04

USPC ..... 312/402, 403, 404, 401, 405, 410, 296, 312/330.1, 116, 236, 348.3; 62/100, 169, 62/268

See application file for complete search history.

(56) References Cited

U.S. PATENT DOCUMENTS

| | | | | |
|---|---|---|---|---|
| 5,271,240 | A * | 12/1993 | Detrick et al. | 62/268 |
| 5,946,919 | A * | 9/1999 | McKinney et al. | 62/3.7 |
| 6,915,657 | B1 * | 7/2005 | Wood | 62/371 |

(Continued)

FOREIGN PATENT DOCUMENTS

| | | | |
|---|---|---|---|
| CN | 1967110 | A | 5/2007 |
| CN | 102116553 | A | 7/2011 |

(Continued)

*Primary Examiner* — Daniel J Troy
*Assistant Examiner* — Andrew Roersma
(74) *Attorney, Agent, or Firm* — Dentons US LLP

(57) ABSTRACT

The present disclosure relates to pressure control in a vegetable room of a refrigerator, and particularly, to a vegetable room of a refrigerator in which pressure is controlled according to vegetable, fruit, and mixture modes. More particularly, the present disclosure relates to a vegetable room of a refrigerator in which different pressures are applied according to vegetable, fruit, and mixture modes such that each pressure corresponds to storage conditions of storage items such as vegetable and fruit stored in an airtight state therein, whereby each storage item is maintained with optimal freshness. The vegetable room for keeping vegetables in storage in a refrigerator, includes: a storage chamber configured to keep food items in storage therein; a controller configured to adjust pressure within the storage chamber; and a vacuum pump configured to draw in air within the airtight storage chamber, wherein the controller may selectively adjust pressure according to a storage item kept in storage within the storage chamber, whereby the vegetable room of the refrigerator may have a plurality of operation modes.

21 Claims, 7 Drawing Sheets

(56) References Cited

U.S. PATENT DOCUMENTS

| | | | | |
|---|---|---|---|---|
| 7,360,371 | B2 * | 4/2008 | Feinauer et al. | 62/169 |
| 7,895,848 | B2 * | 3/2011 | Espinosa | 62/100 |
| 8,065,885 | B2 * | 11/2011 | Wang | 62/78 |
| 2005/0236947 | A1 * | 10/2005 | LeClear et al. | 312/404 |
| 2008/0134706 | A1 * | 6/2008 | Manzo | 62/337 |

FOREIGN PATENT DOCUMENTS

| | | | | | |
|---|---|---|---|---|---|
| CN | 202209835 | U | | 5/2012 | |
| CN | 202420077 | U | | 9/2012 | |
| JP | 2004085004 | A | * | 3/2004 | F25D 23/00 |
| JP | 200530648 | A | | 2/2005 | |
| JP | 2009036440 | A | | 2/2009 | |

* cited by examiner

CLASSIFICATION ACCORDING TO GRADE OF RATE OF RESPIRATION @ 5 ℃

| GRADE | RANG (mg $CO_2$/kr·hr) | TYPE |
|---|---|---|
| VERY LOW | < 5 | DRY FRUITS, GARLIC |
| LOW | 5 ~ 10 | POTATO, PUMPKIN, WATER MELON, APPLE, CITRUS FRUITS |
| MIDDLE | 10 ~ 20 | CARROT, CUCUMBER, TOMATO, PEAR, CABBAGE |
| HIGH | 20 ~ 40 | STRAWBERRY, CHIVAS, LETTUCE |
| VERY HIGH | 40 ~ 60 | KIDNEY BEAN, CUT FLOWERS |
| EXTREMELY HIGH | > 60 | SPINACH, BROCCOLI, MUSHROOM |

REFRIGERATOR VEGETABLE ROOM WITH VARIABLE PRESSURE

CROSS-REFERENCE TO RELATED APPLICATION

Pursuant to 35 U.S.C. §119(a), this application claims the benefit of earlier filing date and right of priority to Korean Application No. 10-2012-0081925, filed on Jul. 26, 2012, the contents of which is incorporated by reference herein in its entirety.

BACKGROUND OF THE INVENTION

1. Field of the Invention

The present disclosure relates to pressure control in a vegetable room of a refrigerator, and particularly, to a vegetable room of a refrigerator in which pressure is controlled according to vegetable, fruit, and mixture modes. More particularly, the present disclosure relates to a vegetable room of a refrigerator in which different pressures are applied according to vegetable, fruit, and mixture modes such that each pressure corresponds to storage conditions of storage items such as vegetable and fruit stored in an airtight state therein, whereby each storage item is maintained with optimal freshness.

2. Background of the Invention

In general, a refrigerator is equipment for keeping food items in storage in a low-temperature state for a long period of time by generating cold air by driving a refrigerating cycle installed therein and supplying generated cold air to the interior of a refrigerating chamber and a freezing chamber.

In general, as illustrated in FIG. 1, a refrigerator 1 includes a freezing chamber 2 and a refrigerating chamber 10, and includes a freezing chamber door 21 and a refrigerating chamber door 11 for opening and closing the freezing chamber 20 and the refrigerating chamber 10. Also, a vegetable room 100 for keeping vegetables and fruits (hereinafter, referred to as 'vegetables') fresh in storage is provided separately in a certain position of the refrigerating chamber 10.

The vegetable room 100, generally provided in a lower end portion of the refrigerator 1, may include a vegetable box for keeping vegetables and fruits in storage and a cover or a drawer for opening and closing the vegetable box. A cover type vegetable room forms a one-box type vegetable room and a drawer type vegetable room forms a two-box type vegetable room.

In the case in which the vegetable room 100 is formed as a drawer type vegetable room, as illustrated in FIG. 2, the drawer type vegetable room includes a vegetable box 110 and a drawer 130 installed in the vegetable box 110 such that it is drawable.

The vegetable box 110 is formed such that a front side is open. The vegetable box 110 is opened and closed as the drawer 130 is reciprocally inserted through the open front portion in a slidable manner.

The vegetable box 110 is formed with a freezing chamber plate, an external plate, an upper plate, and a lower plate. A rear side of the vegetable box 110 is closed, and a front side thereof is open.

In general, when vegetables are kept in storage in the refrigerator, the vegetables are required to be maintained with optimal freshness, so it is important to maintain the space in which vegetables are received or accommodated under an optimal condition.

The drawer hermetically closes the vegetable box 110 to block an air flow from the outside to maintain humidity of an internal space thereof. In general, the interior of the vegetable room 110 is hermetically closed against the outside to maintain pressure different from external pressure.

Thus, when the vehicle chamber 110 is closed, preferably, the interior of the vehicle chamber is hermetically closed with respect to the exterior and maintained in pressure lower than external pressure. To this end, a vacuum pump is actuated to make the interior of the vegetable room 110 be in a weak vacuum state to maintain pressure lower than atmospheric pressure therein.

As illustrated in FIG. 3, a vacuum pump is actuated to maintain the interior of the vegetable room 110 of the related art at predetermined pressure (e.g., 0.65 atm) as single pressure. When the pressure within the vegetable room 110 reaches the pre-set predetermined pressure, the vacuum pump is turned off, and when the pressure within the vegetable room 110 drops below the pre-set predetermined pressure, the vacuum pump is turned on.

Storage items kept in storage in the vegetable room 100 may include food items with leaves (hereinafter, referred to as 'vegetables') such as asparagus, chives, lettuce, spinach, and the like, and food items without leaves (hereinafter, referred to as 'fruits') such as potato, watermelon, lemon, apple, orange, white radish, graph, persimmon, tomato, cucumber, pear, carrot, cabbage, and the like.

As illustrated in FIG. 4, in general, vegetables have large leaves to have a large amount of respiration and transpiration, having a high rate of respiration, while fruits without leaves have a small amount of respiration and transpiration, having a low rate of respiration.

As for magnitudes and grades of rates of respiration, as illustrated in FIG. 4, fruits such as dried fruits, garlic, potato, pumpkin, apple, citrus fruits, carrot, cucumber, tomato, pear, cabbage, and the like, have a low grade (equal to or less than 20), while strawberry, chives, lattice, kidney bean, cut flowers, spinach, broccoli, mushroom, and the like, have a high grade (equal to or more than 20).

However, in a case in which the interior of the vegetable room is uniformly maintained at the same pressure, pressures optimized according to different rates of respiration of vegetables and fruits cannot be maintained, making it difficult to maintain optimal freshness of storage items.

Thus, it is required to differentiate pressures within a vegetable room in order to enhance freshness of the vegetable room in which vegetables and fruits are kept in storage.

SUMMARY OF THE INVENTION

Therefore, an aspect of the detailed description is to provide a vegetable room of a refrigerator in which pressure of a vegetable mode, a fruit mode, and a mixture mode is controlled to be selectively maintained according to a type of food items kept in storage in a vegetable room for vegetables, fruits, and the like, to maintain optimal freshness of the food items.

Another aspect of the detailed description is to provide a vegetable room of a refrigerator in which pressure according to a vegetable mode, a fruit mode, and a mixture mode is controlled to be maintained for optimal freshness of respective food items kept in storage by controlling a vacuum pump by a controller according to types of food items stored in an internal space of a single vegetable room.

Another aspect of the detailed description is to provide a vegetable room of a refrigerator in which pressure in a vegetable room having a vegetable-dedicated storage space for independently keeping only vegetables in storage and pressure in a vegetable room having a fruit-dedicated storage space for independently keeping only fruits in storage are controlled according to a vegetable mode, a fruit mode, and a mixture mode so as to maintain optimal freshness for vegetables and fruits, respectively.

Another aspect of the detailed description is to provide a vegetable room of a refrigerator in which a single internal space of the vegetable room is divided into a first airtight internal space and a second airtight internal space to be used as a vegetable-dedicated storage space and a fruit-dedicated storage space, respectively, and pressure is controlled according to a vegetable mode, a fruit mode, and a mixture mode so as to be appropriately maintained in each space to enhance optimal freshness.

The present invention will be implemented by embodiments having the following configurations as preferred aspects to achieve the above objects. In order to solve the foregoing problem, the present invention provides the following technical configurations.

According to a first embodiment of the present invention, a vegetable room of a refrigerator includes: a storage chamber configured to keep food items in storage therein; a controller configured to adjust pressure within the storage chamber; and a vacuum pump configured to draw in air within the airtight storage chamber, wherein the controller includes a plurality of operation modes for selectively adjusting pressure according to a storage item kept in storage within the storage chamber.

The plurality of operation modes may include a vegetable mode, a fruit mode, and a mixture mode according to a food item kept in storage in the storage chamber, and the controller may select one of the plurality of operation modes according to an operation mode of a storage item, and control the vacuum pump according to the selected mode to selectively adjust pressure within the vegetable room.

The vegetable room may further include: a display unit configured to display the storage item within the vegetable room and the selected operation mode, and display pressure of the vegetable, the fruit, and the mixture modes according to the storage item and an internal pressure state of the vegetable room; and an input unit allowing a user to selectively input one of the vegetable mode, the fruit mode, and the mixture mode according to a storage item kept in storage within the vegetable room.

According to a second embodiment of the present invention, the storage chamber as a storage space of the vegetable room may include a vegetable room having a vegetable-dedicated storage space and a vegetable room having a fruit-dedicated storage space which are separately opened and closed, and the interior of the vegetable-dedicated storage vegetable room may form pressure of the vegetable mode and the interior of the fruit-dedicated storage vegetable room may form pressure of the fruit mode. Namely, a vegetable-dedicated compartment and a fruit-dedicated compartment may be separately provided.

As stated in the first embodiment of the present invention, the display unit and the input unit may be installed in the vegetable-dedicated storage vegetable room and the fruit-dedicated storage vegetable room, respectively.

According to a third embodiment of the present invention, the storage chamber as a storage space of the vegetable room may include: a partition dividing the internal storage space into a first internal storage space and a second internal storage space, wherein the first internal storage space may form a vegetable-dedicated storage space, the second internal storage space may form a fruit-dedicated storage space, and the first internal storage space and the second internal storage space may be formed to be hermetically closed by the partition.

Like the first embodiment of the present invention, the display unit and the input unit may be installed to be exposed from the respective storage spaces.

Here, the controller may maintain 0.85 atm as pressure within the vegetable room in case of the vegetable mode or the vegetable-dedicated storage space, 0.95 atm in case of the fruit mode or the fruit-dedicated storage space, and 0.90 atm in case of the vegetable/fruit mixture mode by controlling the vacuum pump as in the first embodiment of the present invention.

In an embodiment of the present invention, the interior of the vegetable room is selectively maintained with pressure of the vegetable mode, the fruit mode, and the mixture mode within the vegetable room according to a type of a storage item, to thus maintain optimal freshness of the storage item kept in storage.

Also, in an embodiment of the present invention, the controller controls the vacuum pump according to a type of a storage item kept in storage within the internal space of the single vegetable room, so that when various food items are stored, pressure for optimal freshness corresponding to each of the food items can be maintained.

Also, in an embodiment of the present invention, pressure within the vegetable room having the vegetable-dedicated storage space and the vegetable room having the fruit-dedicated storage space is controlled to maintain optimal freshness of vegetables and fruits.

Also, in an embodiment of the present invention, the internal space of the single vegetable room is divided into the first internal space and the second internal space such that the first internal space and the second internal space are hermetically closed, so as to be used as the vegetable-dedicated storage space and the fruit-dedicated storage space, and pressure appropriate for each space is maintained to enhance optimal freshness.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a vegetable room of a refrigerator in which pressure can be controlled according to a vegetable mode, a fruit mode, and a mixture mode according to embodiments of the present invention will be described in detail with reference to the accompanying drawings.

The terms and words used in the present specification and claims should not be interpreted as being limited to typical meanings or dictionary definitions, but should be construed as having meanings and concepts relevant to the technical scope of the present invention based on the rule according to which an inventor can appropriately define the concept of the term to describe most appropriately the best method he or she knows for carrying out the invention.

Therefore, the configurations described in the embodiments and drawings of the present invention are merely most preferable embodiments but do not represent all of the technical spirit of the present invention. Thus, the present invention should be construed as including all the changes, equivalents, and substitutions included in the spirit and scope of the present invention at the time of filing this application.

First, referring to FIG. 4, food items kept in storage in a vegetable room may be divided into food items with leaves (or foliiferous food items) (hereinafter, referred to as 'vegetables') such as asparagus, chives, lettuce, spinach, and the like, and food items without leaves (or aphyllous food items) (hereinafter, referred to as 'fruits') such as potato, water melon, lemon, apple, orange, white radish, graph, persimmon, tomato, cucumber, pear, carrot, cabbage, and the like.

Vegetables have large leaves to have a large amount of respiration and transpiration, having a high rate of respiration, while fruits without leaves have a small amount of respiration and transpiration, having a low rate of respiration.

Figure 1:
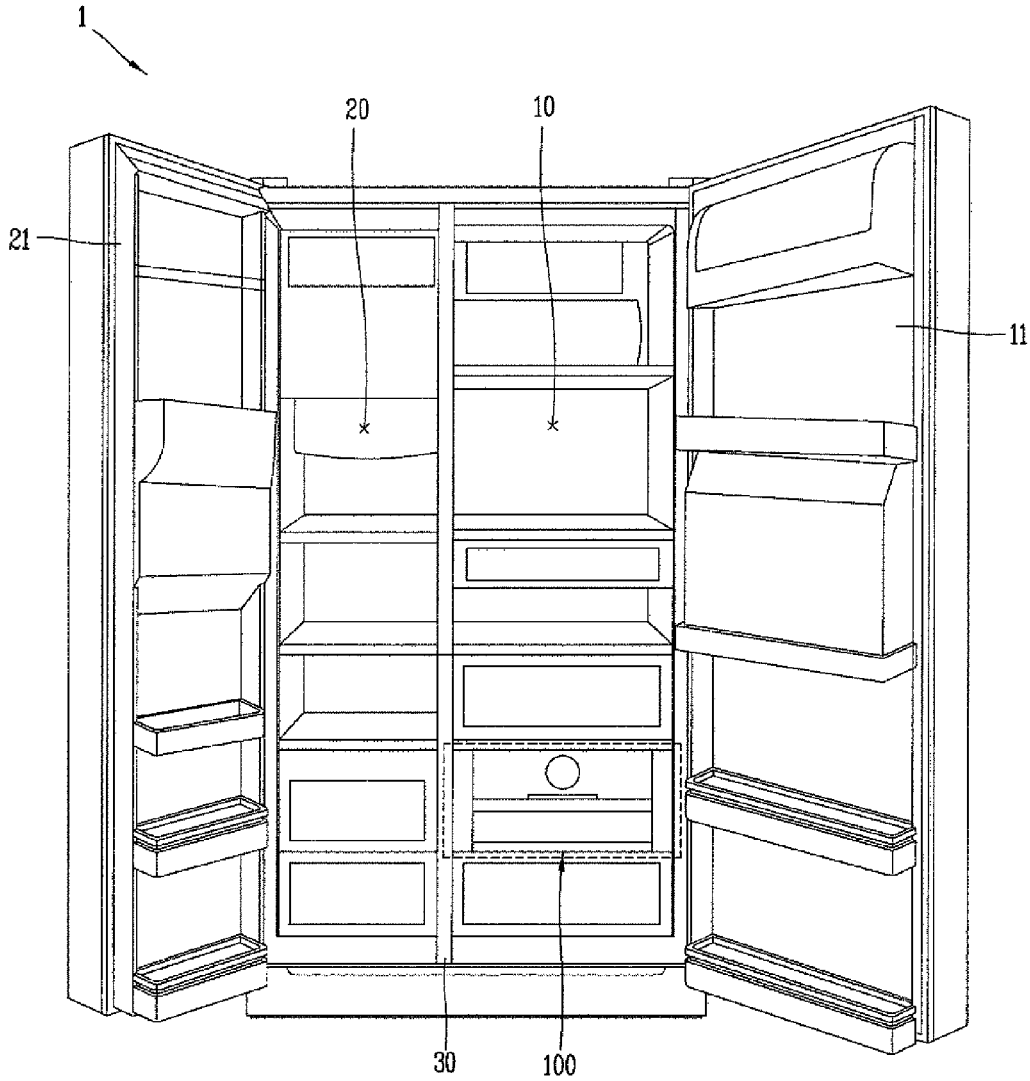
FIG. 1 is a perspective view of a refrigerator having a vegetable room.
Figure 2:
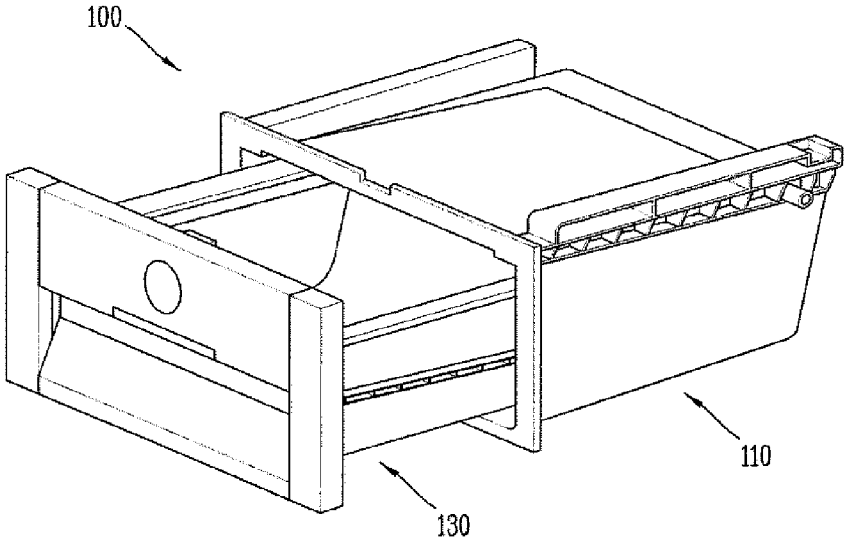
FIG. 2 is a perspective view of the vegetable room.
Figure 3:
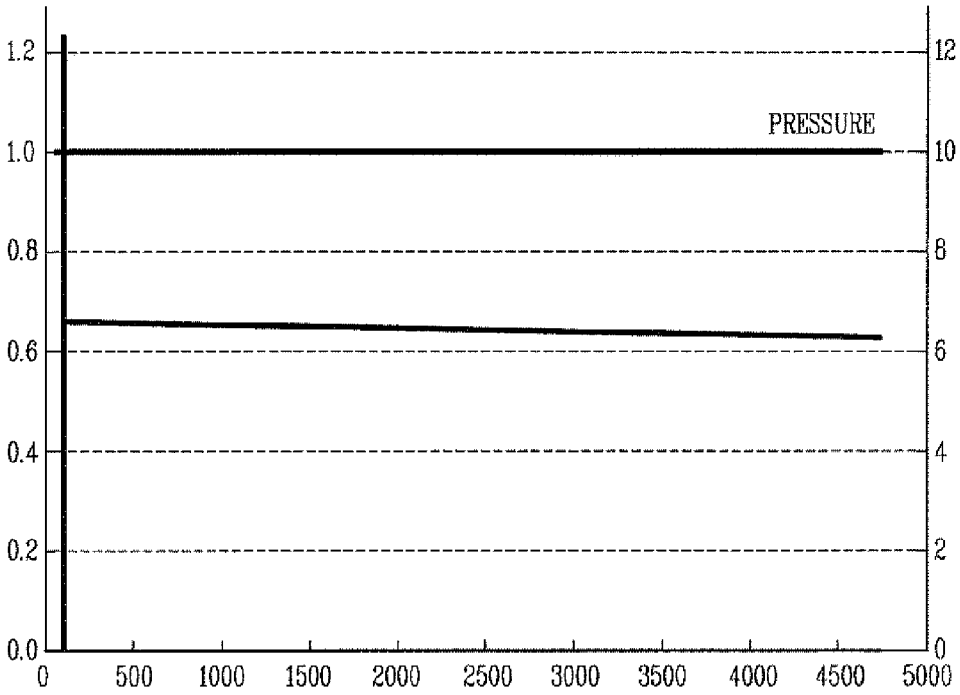
FIG. 3 is a graph showing pressure maintained in a vegetable room according to the related art.
Figure 4:
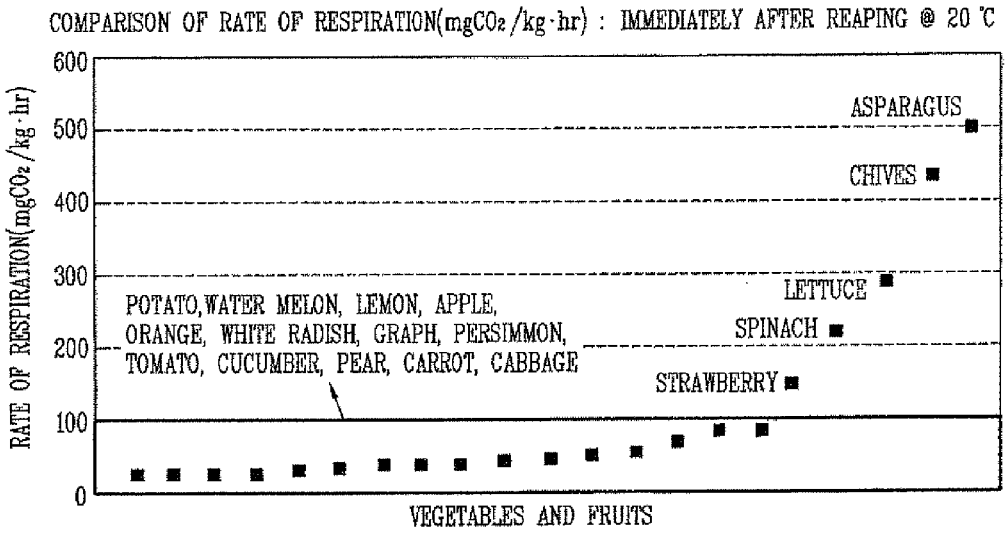
FIG. 4 is a graph showing measured rates of respiration of vegetables and fruits.

As for magnitudes and grades of rates of respiration, as illustrated in a lower table of FIG. 4, fruits such as dried fruits, garlic, potato, pumpkin, apple, citrus fruits, carrot, cucumber, tomato, pear, cabbage, and the like, have a low grade (equal to or less than 20), while strawberry, chives, lattice, kidney bean, cut flowers, spinach, broccoli, mushroom, and the like, have a high grade (equal to or more than 20).

However, in a case in which the interior of the vegetable room is uniformly maintained at the same pressure, pressures optimized according to different rates of respiration of vegetables and fruits cannot be maintained, making it difficult to maintain optimal freshness of storage items.

Thus, in an embodiment of the present invention, in order to enhance freshness of the vegetable room in which vegetables and fruits are kept in storage, the controller controls the vacuum pump such that pressure within the vegetable room is differentiated, whereby internal pressure is selectively controlled for respective storage items.

Hereinafter, the vegetable room of a refrigerator in which pressure can be controlled according to a vegetable mode, a fruit mode, and a mixture mode will be described in detail with reference to FIGS. 5 through 10.

Figure 5:
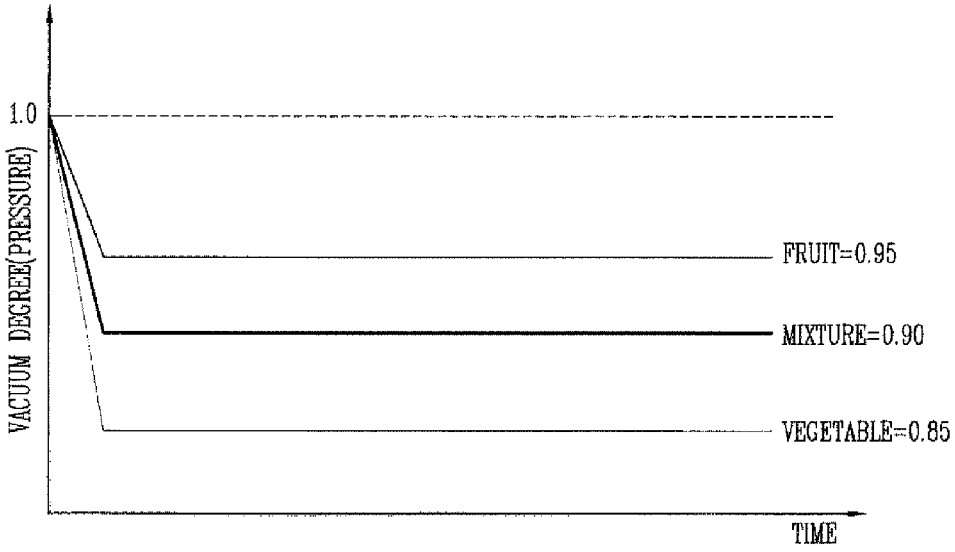
FIG. 5 is a graph showing pressure within a vegetable room in a vegetable mode, a fruit mode, and a mixture mode according to an embodiment of the present invention.
Figure 6:
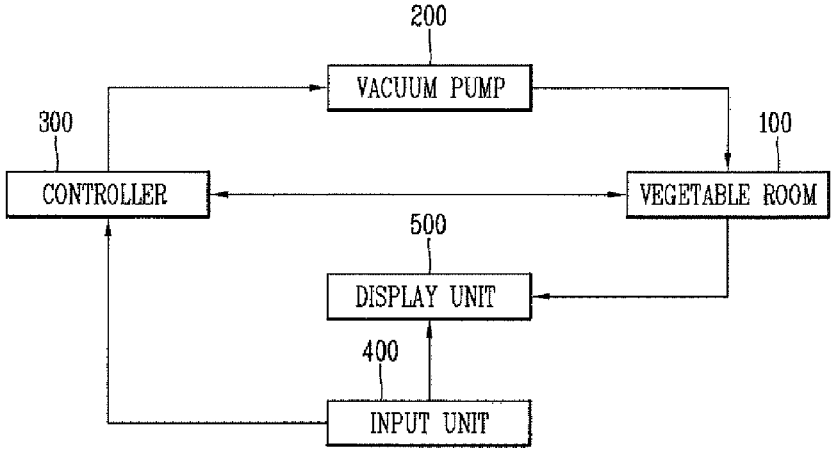
FIG. 6 is a block diagram illustrating a structure for controlling the vegetable room according to an embodiment of the present invention.
Figure 7:
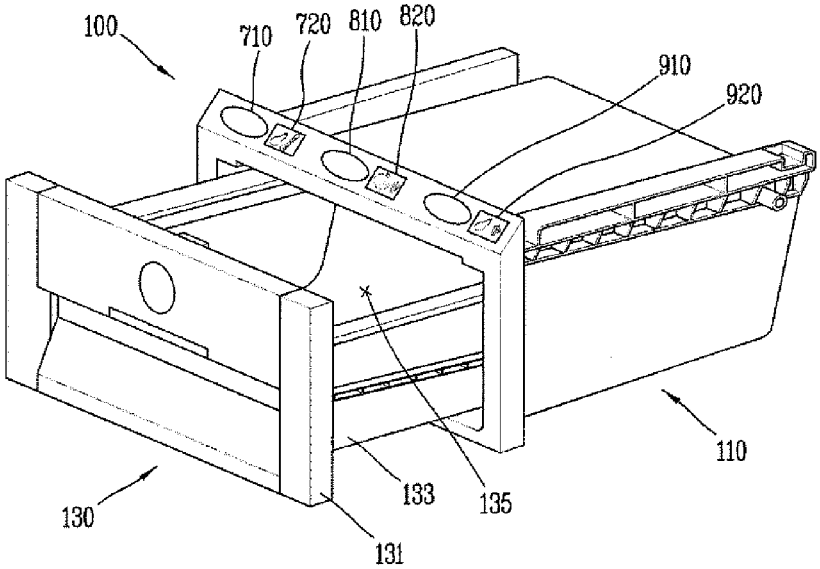
FIG. 7 is a perspective view illustrating a vegetable room in the vegetable mode, the fruit mode, and the mixture mode according to an embodiment of the present invention.

FIGS. 5 and 7 are views illustrating a single vegetable room in which pressure is controlled according to the vegetable mode, the fruit mode, and the mixture mode according to an embodiment of the present invention. FIG. 5 is a graph showing pressure within the vegetable room, FIG. 6 is a block diagram of a structure for controlling the vegetable room, and FIG. 7 is a perspective view of the vegetable room.

Referring to FIGS. 6 and 7, the present invention provides a vegetable room of a refrigerator in which pressure is controlled according to a vegetable room, a fruit chamber, and a mixture chamber. That is, the present invention provides a vegetable room for keeping vegetables fresh in storage, including a vegetable room 100 for hermetically keeping fruits or vegetables in storage therein; a controller 300 configured to adjust pressure and pressure within the vegetable room; and a vacuum pump 200 configured to draw in air within the airtight vegetable room, wherein the controller 300 selectively adjusts pressure in the vegetable mode, the fruit mode, and the mixture mode according to a storage item kept in a storage chamber 135 (or a storage space) within the vegetable room.

In an embodiment of the present invention, three modes for leafy vegetable storage, fruit storage, and mixture (vegetable+fruit) storage are provided. Thus, when a consumer selects a mode according to a type of a food item to be kept in storage, the controller 300 may provide optimal pressure according to the selected mode with respect to the vegetable storage chamber 135 (or the storage space) to enhance freshness of a storage item.

As illustrated in FIG. 6, an internal pressure condition and an operation mode of the vegetable room 100 are controlled by the controller 300, and the vacuum pump 200 is connected to adjust internal pressure.

The vacuum pump 200 is installed in the vegetable room 100, and after the vegetable room 100 is hermetically closed, the vacuum pump 200 draws air within the vegetable room 100 to place the interior of the vegetable room in a weak vacuum state. In the vegetable room 100 in which pressure is selectively maintained in the vegetable mode, the fruit mode, and the mixture mode according to an embodiment of the present invention, the vacuum pump 200 maintains selective pressure according to a storage item stored within the vegetable room 100.

In an embodiment of the present invention, the controller 300 generally manages an internal atmospheric condition and an operation mode of the vegetable room 100 and generally controls actuation of the vacuum pump 200.

Thus, the controller 300 selects one of the vegetable mode, the fruit mode, and the mixture mode according to a storage item kept in storage within the vegetable room 100, and adjusts pressure within the vegetable room 100 by controlling the vacuum pump 200 according to the selected mode.

Thus, in the case in which vegetables are stored within the vegetable room 100, the controller 300 maintains the internal space of the vegetable room 100 at pressure most appropriate for the vegetables, in the case of the fruit mode, the controller 300 maintains the internal space of the vegetable room 100 at the pressure most appropriate for fruits, and in the case of the mixture mode in which vegetables and fruits are mixedly stored, the controller 300 the internal space of the vegetable room 100 at pressure appropriate for maintaining optimal freshness.

A control system of the vegetable room 100 selective for the vegetable mode, the fruit mode, and the mixture mode is operated when the vegetable room 100 of the refrigerator is closed, and the operation of the control system is terminated when the vegetable room 100 is opened.

Referring to FIG. 5, in the case of the vegetable mode, pressure within the vegetable room 100 is maintained at 0.85 atm, in the case of the fruit mode, pressure within the vegetable room 100 is maintained at 0.95 atm, and in the case of the vegetable/fruit mixture mode, pressure within the vegetable room 100 is maintained at 0.90 atm.

Each pressure with respect to the vegetable mode, the fruit mode, and the mixture mode is pre-set pressure required for maintaining optimal freshness of a storage item in a vegetable, fruit, and mixture storage state.

The pre-set pressure is optimal pressure in the internal space of the vegetable room 100, which is experimentally calculated by analyzing dryness of food.

In detail, according to a method for deriving the optimal pressure, vegetable and fruit are kept in storage in the vegetable room 100 in which pressure conditions are set to be different in the refrigerator, and degrees (Δ%) of dryness of food items are measured by using initial weights of the target food items and weights after a predetermined period of time (seven days) has lapsed.

The experiment is repeatedly performed, and a case in which dryness is the lowest is set as optimal pressure. An equation of deriving the optimal pressure is as follows.

$$\text{Dryness (\%)} = \frac{\text{(Weight of initial sample)} - \text{(Weight of sample after seven days)}}{\text{Weight } fo \text{ initial sample}} \times 100$$

Thus, when fruit is maintained at pressure close to 1.0 atm, an average pressure outside the vegetable room 100, fruit can be more kept in storage fresh, and vegetable can be kept in storage fresh when internal pressure is approximately 0.8 atm. Thus, the user can adjust reference pressure within the vegetable room 100 according to each selection mode.

Referring to FIGS. 6 and 7, in an embodiment of the present invention, a display unit 500 for displaying storage items within the vegetable room 100 and a selected operation mode and displaying pressure in the vegetable, the fruit, and the mixture modes according to the storage items and a pressure state within the vegetable room is additionally provided.

The display unit 500 displays a state of the vegetable room 100, a selection mode, and an pressure condition, so that the user may check or view it. In general, preferably, the display unit 500 is installed in a front portion of the vegetable room 100 to allow the user to easily recognize it. An pressure and a vacuum state of the vegetable room 100 are displayed on the display unit 500 to allow the user to easily check an internal state of the vegetable room 100.

As illustrated in FIG. 7, the display unit 500 includes a vegetable mode display unit 720 with respect to the vegetable mode, a fruit mode display unit 820 with respect to the fruit mode, and a mixture mode display unit 920 with respect to the mixture mode. Preferably, the vegetable mode display unit 720, the fruit mode display unit 820, and the mixture mode display unit 920 are installed in a front upper portion of the vegetable box 110.

Also, as illustrated in FIG. 6, an input unit 400 allowing the user to selectively input one of the vegetable mode, the fruit mode, and the mixture mode according to a storage item stored within the vegetable room 100 therethrough is additionally provided.

The input unit 400 serves to allow the user to execute a weak vacuum algorithm module of the vegetable room 100 from the outside, and preferably, the input unit 400 is installed in a position in which the user can easily perform inputting at an outer side of the vegetable room.

The input unit 400 transfers a selection mode or an atmosphere pressure condition input by the user to the controller 300. Thus, the controller 300 actuates the vacuum pump 200 according to each selection mode, and checks a state of the vegetable room 100 to generally control a condition within the vegetable room 100.

The input unit 400 may include a vegetable mode input unit 710 with respect to the vegetable mode, a fruit mode input unit 810 with respect to the fruit mode, and a mixture mode input unit 910 with respect to the mixture mode. Preferably, the vegetable mode input unit 71, the fruit mode input unit 810, and the mixture mode input unit 910 are installed in a front upper portion of a vegetable box 110.

Hereinafter, independent control of pressure of the vegetable room 100 having an independent vegetable-dedicated storage space for storing vegetables and an independent fruit-dedicated storage space for storing fruits according to another embodiment of the present invention will be described.

Figure 8:
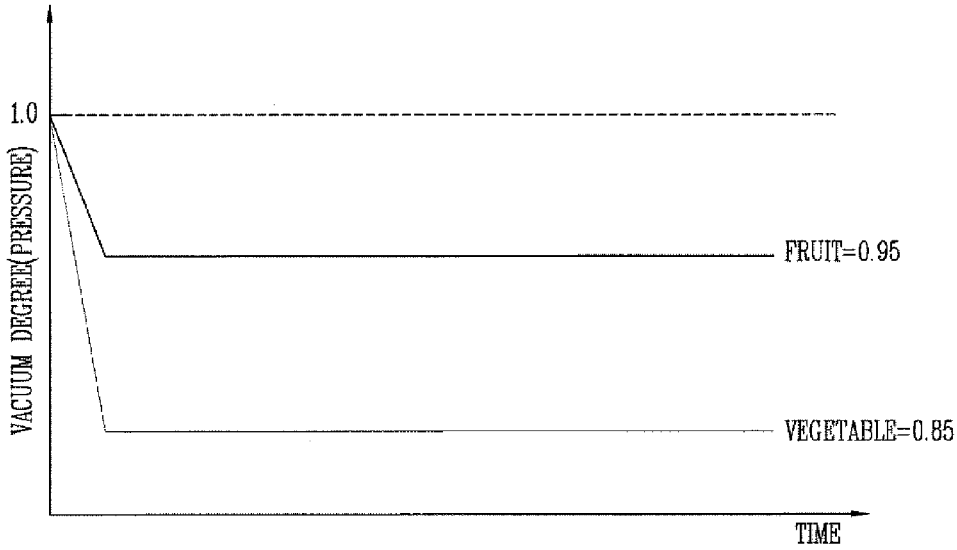
FIG. 8 is a graph showing pressure in a vegetable-dedicated storage vegetable room and a fruit-dedicated storage vegetable room according to an embodiment of the present invention.
Figure 9A:
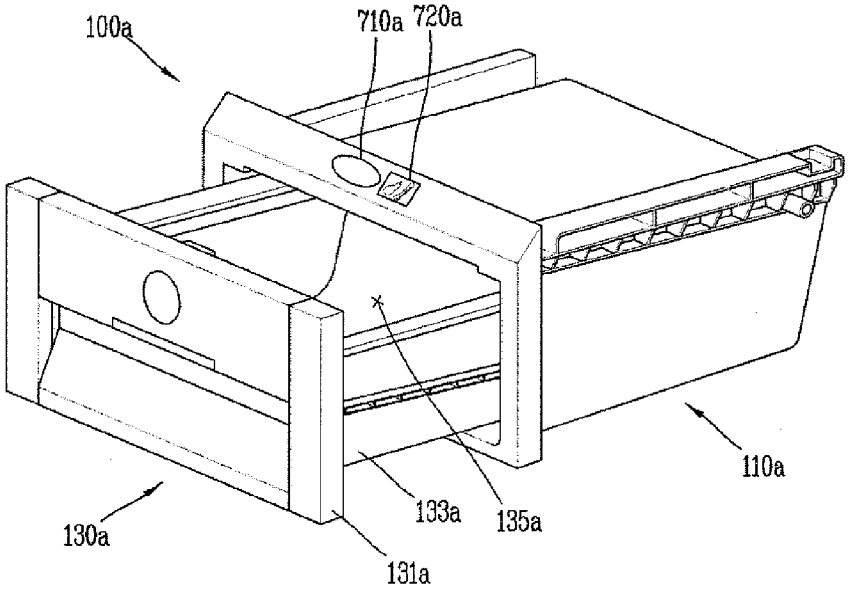
FIGS. 9(*a*) and 9(*b*) are perspective views of the vegetable-dedicated storage vegetable room and the fruit-dedicated storage vegetable room according to an embodiment of the present invention.
Figure 9B:
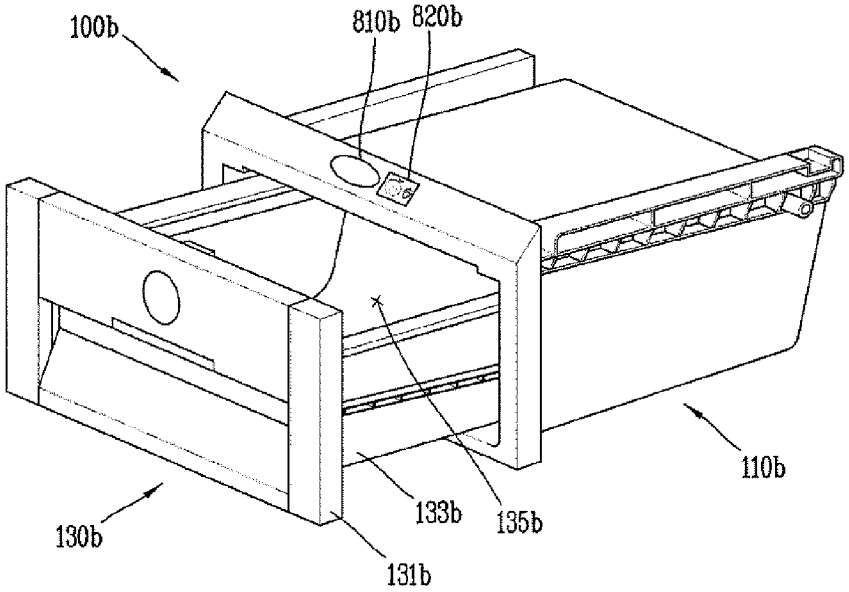
Figure 10:
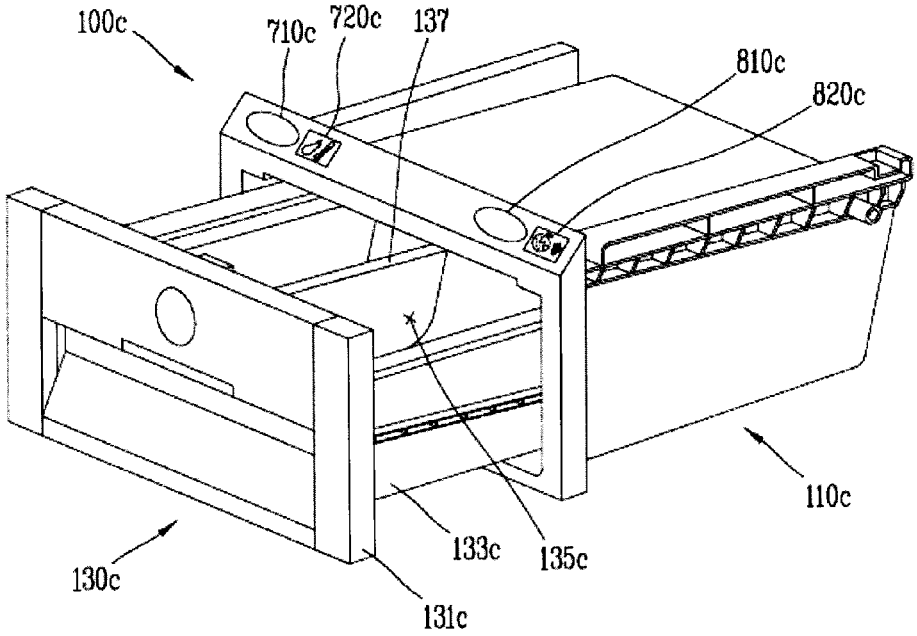
FIG. 10 is a view illustrating a vegetable-dedicated storage space and a fruit-dedicated storage space hermetically divided by a partition according to another embodiment of the present invention.

FIG. 8 is a graph showing pressure in a vegetable-dedicated storage vegetable room and a fruit-dedicated storage vegetable room according to an embodiment of the present invention. FIGS. 9(*a*) and 9(*b*) are perspective views of the vegetable-dedicated storage vegetable room and the fruit-dedicated storage vegetable room provided as independent vegetable rooms according to an embodiment of the present invention. FIG. 10 is a view illustrating a vegetable-dedicated storage space and a fruit-dedicated storage space hermetically divided by a partition according to another embodiment of the present invention.

Referring to FIG. 8, in the case in which a vegetable-dedicated storage space and a fruit-dedicated storage space according to an embodiment of the present invention are formed, preferably, the fruit-dedicated storage space is maintained at 0.95 atm, and the vegetable-dedicated storage space is maintained at 0.85 atm.

The pressure values for the internal spaces of the vegetable room for maintaining optimal freshness in the vegetable mode and the fruit mode are set according to an experiment, and a detailed description thereof will be omitted.

FIGS. 9(*a*) and 9(*b*) illustrate another embodiment of the present invention. Referring to FIGS. 9(*a*) and 9(*b*), the vegetable room includes a vegetable room 100*a* having a vegetable-dedicated storage space 135*a* and a vegetable room 100*b* having a fruit-dedicated storage space 135*b*, which are separately opened and closed. The interior 135*a* of the vegetable-dedicated storage vegetable room has pressure of the vegetable mode, and the interior 135*b* of the fruit-dedicated storage vegetable room forms pressure of the fruit mode.

According to the present embodiment, both the vegetable-dedicated chamber and the fruit-dedicated chamber are provided. Namely, the dedicated vegetable rooms for vegetables and fruits are separately provided.

Thus, storage items of fruits are kept in storage in the fruit-dedicated storage space 135*b*, and storage items of vegetables are kept in storage in the vegetable-dedicated storage space 135*a*, and optimal pressure is maintained therein. Thus the user may keep vegetables and fruits, separately, in storage, and an optimal pressure condition appropriate for vegetables and fruits can be provided.

In the present embodiment, the controller 300 forms pressure of 0.85 atm in the interior 135*a* of the vegetable-dedicated storage vegetable room 100*a* and pressure of 0.95 atm in the interior 135*b* of the fruit-dedicated storage vegetable room 100*b*.

The vegetable-dedicated storage vegetable room 100*a* further includes a vegetable storage chamber display unit 720*a* for displaying pressure of the vegetable mode and a pressure state within the vegetable room, and the fruit-dedicated storage vegetable room 100*b* further includes a fruit storage vegetable room display unit 820*b* for displaying pressure of the fruit mode and displaying a pressure state within the vegetable room.

In an embodiment of the present invention, preferably, the vegetable-dedicated storage vegetable room 100*a* further includes a vegetable storage vegetable room input unit 710*a* allowing the user to input internal pressure according to the vegetable mode, and the fruit-dedicated storage vegetable room 100*b* further includes a fruit storage vegetable room input unit 810*b* allowing the user to input internal pressure according to the fruit mode.

In the present embodiment, the display units 720*a* and 820*b* and the input units 710*a* and 810*b* are components corresponding to the display unit 500 and the input unit 400 of the former embodiment, so a detailed description thereof will be omitted.

Another embodiment of the present invention will be described in detail with reference to FIG. 10. A vegetable room 100*c* includes a partition 137 dividing the storage chamber 135 as an internal storage space into a first internal storage space 135*ca* and a second internal storage space 135*cb*. The first internal storage space 135*ca* forms a vegetable-dedicated storage space, and the second internal storage space 135*cb* forms a fruit-dedicated storage space. The first internal storage space 135*ca* and the second internal storage space 135*cb* may be hermetically closed by the partition 137.

Thus, the internal space of the vegetable room 100*c* is separated by the single partition 137 into two storage spaces, i.e., the vegetable-dedicated storage space and the fruit-dedicated storage space.

The user may keep vegetables and fruits in storage separately in the divided internal spaces of the single vegetable room, rather than individual vegetable rooms, under separate optimal pressure conditions appropriate for the vegetables and fruits, enhancing freshness.

Thus, like the former embodiment, the controller 300 controls the first internal storage space 135*ca* such that pressure of 0.85 atm is formed therein, and controls the second internal storage space 135*cb* such that pressure of 0.95 atm is formed therein.

The first internal storage space 135*ca* may further include a first display unit 720*c* for displaying pressure of the vegetable mode and displaying an internal pressure state of the first internal storage space, and the second internal storage space 135*cb* may further include a second display unit 820*c* for displaying pressure of the fruit mode and displaying an internal pressure state of the second internal storage space.

In addition, the first internal storage space 135*ca* may further include a first input unit 710*c* allowing the user to input internal pressure according to the fruit mode, and the second internal storage space 135*cb* may further include a second input unit 810*c* allowing the user to input internal pressure according to the fruit mode.

In the present embodiment, the display units 720*c* and 820*c* and the input units 710*c* and 810*c* are components corresponding to the display unit 500 and the input unit 400 of the former embodiment, so a detailed description thereof will be omitted.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A vegetable room for keeping foods in storage in a refrigerator, the vegetable room comprising:

a vegetable box configured to be fixed, the vegetable box having an accommodation space with a front side opened;

a drawer configured to be moved, such that the drawer can be pushed into and pulled out of the accommodation space, the drawer having a storage chamber to store the foods therein;

a controller configured to adjust a pressure within the storage chamber according to the foods stored in the storage chamber; and a vacuum pump to draw air within the storage chamber to thereby adjust the pressure within the storage chamber, wherein the pressure within the storage chamber is selectively controlled according to one mode of a fruit mode, a vegetable mode and a mixture mode, the pressure within the storage chamber is ranged from 0.93 atm close to 1.0 atm according to the fruit mode such that the pressure is optimized according to a rate of respiration of fruits, when fruits are stored in the storage chamber, the pressure within the storage chamber is ranged from 0.87 atm close to 0.93 atm according to the mixture mode such that the pressure is optimized according to a medium rate of respiration of fruits and vegetables, when fruits and vegetables are stored in the storage chamber, and the pressure within the storage chamber is ranged from 0.80 atm close to 0.87 atm according to the vegetable mode such that the pressure is optimized according to a rate of respiration of vegetables, when vegetables are stored in the storage chamber, wherein each pressure with respect to the vegetable mode, the fruit mode, and the mixture mode is a pre-set pressure required for maintaining optimal freshness of the foods, the pre-set pressure is derived from degrees (Δ%) of dryness of foods, an equation of deriving the pre-set pressure is as follows:

$$\text{Degrees } (\Delta\ \%) \text{ of Dryness} = \frac{(\text{Weight of initial sample}) - (\text{Weight of sample after predetermined period of time})}{\text{Weight of initial sample}} \times 100,$$

and a case in which the degrees (Δ%) of dryness is the lowest is set as the pre-set pressure.

2. The vegetable room of claim 1, wherein the controller adjusts the pressure within the storage chamber at 0.85 atm in the case of the vegetable mode, adjusts the pressure within the storage chamber at 0.95 atm in the case of the fruit mode, and adjusts the pressure within the storage chamber at 0.90 atm in the case of mixture mode.

3. The vegetable room of claim 1, further comprising:

an input unit allowing a user to selectively input one of the vegetable mode, the fruit mode, and the mixture mode according to the foods kept in storage within the storage chamber.

4. The vegetable room of claim 1, wherein the vegetable room is provided in plurality and includes a vegetable room having a vegetable-dedicated storage chamber and a separate vegetable room having a fruit-dedicated storage chamber, wherein the controller adjusts the pressure within the vegetable-dedicated storage chamber according to the pressure of the vegetable mode and the controller adjusts the pressure within the fruit-dedicated storage chamber according to the pressure of the fruit mode.

5. The vegetable room of claim 4, wherein the controller adjusts the pressure to 0.85 atm within the vegetable-dedicated storage chamber, and adjusts the pressure to 0.95 atm within the fruit-dedicated storage chamber.

6. The vegetable room of claim 4, wherein the vegetable-dedicated storage vegetable room further comprises a vegetable storage vegetable room display unit, wherein the controller causes the vegetable storage vegetable room display unit to display an internal pressure state of the vegetable-dedicated storage chamber according to the vegetable mode, and the fruit-dedicated storage vegetable room comprises a fruit storage vegetable room display unit, wherein the controller causes the fruit storage vegetable room display unit to display an internal pressure state of the fruit-dedicated storage chamber according to the fruit mode.

7. The vegetable room of claim 4, wherein the vegetable-dedicated storage vegetable room comprises a vegetable storage vegetable room input unit allowing a user to input according to the vegetable mode, and the fruit-dedicated storage vegetable room comprises a fruit storage vegetable room input unit allowing the user to input according to the fruit mode.

8. The vegetable room of claim 1, further comprising:

a display unit, wherein the controller causes the display unit to display at least one of the operation mode and an internal pressure state of the storage chamber.

9. The vegetable room of claim 1, further comprising:

a first input unit allowing the user to input according to the vegetable mode; and a second input unit allowing the user to input according to the fruit mode.

10. A refrigerator comprising:

a refrigerating chamber;

a refrigerating chamber door to open and close the refrigerating chamber;

at least one vegetable room including a vegetable box configured to be fixed, the vegetable box having an accommodation space with a front side opened, and a drawer configured to be moved, such that the drawer can be pushed into and pulled out of the accommodation space, the drawer having a storage chamber to keep a food item in storage therein, the vegetable room disposed in the refrigerating chamber;

a controller configured to adjust a pressure within the storage chamber; and a vacuum pump to draw air within the storage chamber to thereby adjust the pressure within the storage chamber, wherein the pressure within the storage chamber is selectively controlled according to one mode of a fruit mode, a vegetable mode and a mixture mode, the pressure within the storage chamber is ranged from 0.93 atm close to 1.0 atm according to the fruit mode such that the pressure is optimized according to a rate of respiration of fruits, when fruits are stored in the storage chamber, the pressure within the storage chamber is ranged from 0.87 atm close to 0.93 atm according to the mixture mode such that the pressure is optimized according to a medium rate of respiration of fruits and vegetables, when fruits and vegetables are stored in the storage chamber, and the pressure within the storage chamber is ranged from 0.80 atm close to 0.87 atm according to the vegetable mode such that the pressure is optimized according to a rate of respiration of vegetables, when vegetables are stored in the storage chamber, wherein each pressure with respect to the vegetable mode, the fruit mode, and the mixture mode is a pre-set pressure required for maintaining optimal freshness of the food item, the pre-set pressure is derived from degrees (Δ%) of dryness of the food item, an equation of deriving the pre-set pressure is as follows:

$$\text{Degrees } (\Delta\ \%) \text{ of Dryness} = \frac{(\text{Weight of initial sample}) - (\text{Weight of sample after predetermined period of time})}{\text{Weight of initial sample}} \times 100,$$

and a case in which the degrees (Δ%) of dryness is the lowest is set as the pre-set pressure.

11. The refrigerator of claim 10, wherein the controller adjusts the pressure within the storage chamber at 0.85 atm in the case of the vegetable mode, adjusts the pressure within the storage chamber at 0.95 atm in the case of the fruit mode, and adjusts the pressure within the storage chamber at 0.90 atm in the case of mixture mode.

12. The refrigerator of claim 10, further comprising:

an input unit allowing a user to selectively input one of the vegetable mode, the fruit mode, and the mixture mode according to the food item kept in storage within the storage chamber.

13. The refrigerator of claim 10, wherein the vegetable room is provided in plurality and includes a first vegetable room having a vegetable-dedicated storage chamber and a second vegetable room having a fruit-dedicated storage chamber, wherein the controller adjusts the pressure within the vegetable-dedicated storage chamber according to the pressure of the vegetable mode and the controller adjusts the pressure within the fruit-dedicated storage chamber according to the pressure of the fruit mode.

14. The refrigerator of claim 10, further comprising:

a display unit, wherein the controller causes the display unit to display at least one of the operation mode and an internal pressure state of the storage chamber.

15. The refrigerator of claim 10, wherein the vegetable room includes a partition dividing the internal space into a first internal storage space and a second internal storage space, wherein the first internal storage space forms a vegetable-dedicated storage space, the second internal storage space forms a fruit-dedicated storage space, and the first internal storage space and the second internal storage space are hermetically partitioned by the partition.

16. A vegetable room for keeping a food item in storage in a refrigerator, the vegetable room comprising:

a vegetable box configured to be fixed, the vegetable box having an accommodation space with a front side opened;

a drawer configured to be moved, such that the drawer can be pushed into and pulled out of the accommodation space, the drawer having a storage chamber to keep the food item in storage therein;

a controller configured to adjust pressure within the storage chamber; and a vacuum pump to draw air within the storage chamber to thereby adjust the pressure within the storage chamber, wherein a partition is extended vertically upward from a bottom surface of the storage chamber along a drawing direction of the drawer such that the storage chamber is divided into a first internal storage space and a second internal storage space, the first internal storage space arranged facing a side opposite the second internal storage space and sharing a main surface of the drawer with the second internal storage space, wherein a pressure of the first internal storage space and a pressure of the second internal storage space are each separately controlled according to food items stored respectively therein, wherein each pressure of the first internal storage space and the second internal storage space is a pre-set pressure required for maintaining optimal freshness of the food items, the pre-set pressure is derived from degrees (Δ%) of dryness of the food items, an equation of deriving the pre-set pressure is as follows:

$$\text{Degrees } (\Delta\ \%) \text{ of Dryness} = \frac{(\text{Weight of initial sample}) - (\text{Weight of sample after predetermined period of time})}{\text{Weight of initial sample}} \times 100,$$

and a case in which the degrees (Δ%) of dryness is the lowest is set as the pre-set pressure.

17. The vegetable room of claim 16, wherein the first internal storage space forms a vegetable-dedicated storage space, the second internal storage space forms a fruit-dedicated storage space, and the first internal storage space and the second internal storage space are hermetically partitioned by the partition.

18. The vegetable room of claim 16, wherein the controller controls the first internal storage space to have a pressure of 0.85 atm and the second internal storage space to have a pressure of 0.95 atm.

19. The vegetable room of claim 16, further comprising:

a first display unit, wherein the controller causes the first display unit to display an internal pressure state of the first internal storage space according to the vegetable mode; and a second display unit, wherein the controller causes the second display unit to display an internal pressure state of the second internal storage space according to the fruit mode.

20. A refrigerator comprising:

a refrigerating chamber;

a refrigerating chamber door to open and close the refrigerating chamber;

at least one vegetable room including a vegetable box configured to be fixed, the vegetable box having an accommodation space with a front side opened, and a drawer configured to be moved, such that the drawer can be pushed into and pulled out of the accommodation space, the drawer having a storage chamber to keep a food item in storage therein, the vegetable room disposed in the refrigerating chamber;

a controller configured to adjust a pressure within the storage chamber; and a vacuum pump to draw air within the storage chamber to thereby adjust the pressure within the storage chamber, wherein a partition is extended vertically upward from a bottom surface of the storage chamber along a drawing direction of the drawer such that the storage chamber is divided into a first internal storage space and a second internal storage space, the first internal storage space arranged facing a side opposite the second internal storage space and sharing a main surface of the drawer with the second internal storage space, wherein a pressure of the first internal storage space and a pressure of the second internal storage space are each separately controlled according to food items stored respectively therein, wherein each pressure of the first internal storage space and the second internal storage space is a pre-set pressure required for maintaining optimal freshness of the food items, the pre-set pressure is derived from degrees (Δ%) of dryness of the food items, an equation of deriving the pre-set pressure is as follows:

$$\text{Degrees}(\Delta\ \%)\ \text{of Dryness} = \frac{(\text{Weight of initial sample}) - (\text{Weight of sample after predetermined period of time})}{\text{Weight of initial sample}} \times 100,$$

and a case in which the degrees (Δ%) of dryness is the lowest is set as the pre-set pressure.

21. The refrigerator of claim 20, wherein the first internal storage space forms a vegetable-dedicated storage space, the second internal storage space forms a fruit-dedicated storage space, and the first internal storage space and the second internal storage space are hermetically partitioned by the partition.

* * * * *